US005513711A

United States Patent [19]

Williams

[11] Patent Number: 5,513,711

[45] Date of Patent: May 7, 1996

[54] SEALED AND LUBRICATED ROTARY CONE DRILL BIT HAVING IMPROVED SEAL PROTECTION

[76] Inventor: Mark E. Williams, 2839 Red Oak Dr., Grand Prairie, Tex. 75052

[21] Appl. No.: 299,484

[22] Filed: Aug. 31, 1994

[51] Int. Cl.[6] ..... E21B 10/22

[52] U.S. Cl. ..... 175/57; 175/337; 175/339; 175/371

[58] Field of Search ..... 175/371, 57, 228, 175/337, 339

[56] References Cited

U.S. PATENT DOCUMENTS

| | | | |
|---|---|---|---|
| 3,096,835 | 7/1963 | Neilson . | |
| 3,125,175 | 3/1964 | Medlock et al. . | |
| 3,467,448 | 9/1969 | Galle . | |
| 3,604,523 | 6/1970 | Lichte | 175/372 |
| 3,656,764 | 4/1972 | Robinson | 277/92 |
| 3,739,864 | 6/1973 | Cason, Jr. et al. | 175/228 |
| 3,921,735 | 11/1975 | Dysart | 175/337 |
| 3,952,815 | 4/1976 | Dysart | 175/374 |
| 4,056,153 | 11/1977 | Miglierini | 175/376 |
| 4,073,548 | 2/1978 | Walters | 175/228 |
| 4,087,100 | 5/1978 | Yoshihashi et al. | 277/92 |
| 4,092,054 | 5/1978 | Dye | 175/337 X |
| 4,098,358 | 7/1978 | Klima | 175/65 |
| 4,102,419 | 7/1978 | Klima | 175/371 |
| 4,158,394 | 6/1979 | Ernst et al. | 175/228 |
| 4,176,848 | 12/1979 | Lafuze | 277/92 |
| 4,179,003 | 12/1979 | Cooper et al. | 175/371 |
| 4,183,416 | 1/1980 | Walters | 384/269 |
| 4,183,417 | 1/1980 | Levefelt | 175/339 |
| 4,199,856 | 4/1980 | Farrow et al. | 29/454 |
| 4,225,144 | 9/1980 | Zitz et al. | 277/12 |
| 4,249,622 | 2/1981 | Dysart | 175/227 |
| 4,253,710 | 3/1981 | Goodman | 175/372 X |
| 4,256,193 | 3/1981 | Kunkel et al. | 175/371 |
| 4,258,806 | 3/1981 | Kunkel et al. | 175/370 |
| 4,272,134 | 6/1981 | Levefelt | 175/337 X |
| 4,279,450 | 7/1981 | Morris | 175/372 X |
| 4,284,310 | 8/1981 | Olschewski et al. | 175/372 X |
| 4,287,957 | 9/1981 | Evans | 175/17 |
| 4,298,079 | 11/1981 | Norlander et al. | 175/339 |
| 4,375,242 | 3/1983 | Galle | 175/228 |
| 4,386,668 | 6/1983 | Parish | 175/228 |
| 4,388,984 | 6/1983 | Oelke | 184/54 |
| 4,421,184 | 12/1983 | Mullins | 175/337 |
| 4,453,836 | 6/1984 | Klima | 384/94 |
| 4,515,228 | 5/1985 | Dolezal et al. | 175/313 |
| 4,533,003 | 8/1985 | Bailey et al. | 175/269 |
| 4,552,233 | 11/1985 | Klima | 175/371 |
| 4,593,775 | 6/1986 | Chaney et al. | 175/228 |
| 4,597,455 | 7/1986 | Walters et al. | 175/228 |
| 4,610,319 | 9/1986 | Kalai | 175/371 |
| 4,610,452 | 9/1986 | DiRienz | 277/83 |

(List continued on next page.)

FOREIGN PATENT DOCUMENTS

| | | | |
|---|---|---|---|
| 1056075 | 4/1959 | Germany | 175/339 |
| 1048103 | 10/1983 | U.S.S.R. | 175/339 |
| 1148958 | 4/1985 | U.S.S.R. | 175/339 |
| 2019921 | 11/1979 | United Kingdom | 175/339 |

*Primary Examiner*—Hoang C. Dang

[57] ABSTRACT

A rotary cone drill bit (10) for forming a borehole includes a support arm-cutter assembly (26). A support arm (28) is integrally formed with the drill bit's body (22) with a spindle (30) machined integral thereto. The assembly (26) includes a cutter (12) with a cavity (34) for receiving the spindle (30). An inner seal gland (44) is formed between the spindle (30) and a wall (42) of the cavity (34). An elastomeric seal (46) is disposed in the inner seal gland (44) to form a first fluid barrier between. An outer seal gland (50) is formed between the spindle (30) and the cavity wall (42) and between the inner seal gland (44) and the borehole. A ring (56) is disposed in the outer seal gland (50) to rotate with the cutter (12). The ring (56) has a peripheral hole (58) therethrough. A gas conduit (60) is disposed within the support arm (28) for directing a flow of a gas, such as air, into the outer seal gland (50). From the outer seal gland (50), the gas is directed through the hole (58) in the ring (56) and exits into the borehole to form high velocity jets of air to dean a mating surface between the arm (28) and the cutter (12) preventing borehole debris from entering the inner seal gland (44).

26 Claims, 3 Drawing Sheets

U.S. PATENT DOCUMENTS

| | | | |
|---|---|---|---|
| 4,629,338 | 12/1986 | Ippolito | 384/94 |
| 4,688,651 | 8/1987 | Dysart | 175/371 |
| 4,813,502 | 3/1989 | Dysart | 175/337 |
| 4,865,136 | 9/1989 | White | 175/227 |
| 4,942,930 | 7/1990 | Millsapps | 175/228 |
| 4,981,182 | 1/1991 | Dysart | 175/71 |
| 5,027,911 | 7/1991 | Dysart | 175/57 |
| 5,080,183 | 1/1992 | Schumacher et al. | 175/371 |
| 5,131,480 | 7/1992 | Lockstedt et al. | 175/374 |
| 5,145,016 | 9/1992 | Estes | 175/331 |

AIR FLOW
62
60
65
66
26
69
68
28
64

52
14
58
50
56
46
44
38
63
49
12
61
36
16
40
30
42
40
48
14
38
36
34

SEALED AND LUBRICATED ROTARY CONE DRILL BIT HAVING IMPROVED SEAL PROTECTION

This application is related to U.S. patent application Ser. No. 08/299,821, filed Aug. 31, 1994, entitled *Flat Seal for a Roller Cone Rock Bit;* U.S. patent application Ser. No. 08/299,485, filed Aug. 31, 1994, entitled *Compression Seal for a Roller Cone Rock Bit;* and U.S. patent application Ser. No. 08/299,492, filed Aug. 31, 1994 entitled *Roller Cone Rock Bit Having a Sealing System with Double Elastomer Seals* now U.S. Pat. No. 5,441,120.

TECHNICAL FIELD OF THE INVENTION

The present invention relates generally to earth-boring drill bits and more specifically to a sealed and lubricated rotary cone drill bit having improved seal protection.

BACKGROUND OF THE INVENTION

To increase the useful life of a rotary cone drill bit, engineers have developed support arm-cutter assemblies that reduce or eliminate the amount of borehole debris that contacts the inner seal and clean the area outside the seal gland. The inner seal is typically formed from an elastomeric material and is disposed in an inner seal gland to form a fluid barrier between the borehole and the bearing-surface regions within the cone cutter cavity. Debris, such as fine cuttings generated while drilling, within the inner seal gland, often wears against the elastomeric seal and its mating surface as the cutter rotates about the support-arm spindle. Over a period of use, the contacting debris wears the seal and the mating surface sufficiently to gain entrance into the bearing-surface regions. The debris then wears against the bearing surfaces, decreasing the lifetime of the drill bit. Therefore, reducing the amount of borehole debris that enters the inner seal gland often increases the useful life of the rotary cone drill bit.

Conventional air-environment arm-cutter assemblies, such as those used for the formation of blast holes, direct a gas, such as air, into the arm-cutter gap between the backface of the cutter and the last machined surface of the support arm to reduce the amount of debris that contacts the inner seal. The gas is directed to flow out of the gap and into the borehole to reduce the amount of debris entering the inner seal gland.

U.S. Pat. No. 4,183,417, issued to Levefelt and entitled *Roller Bit Seal Excluded From Cuttings By Air Discharge,* discloses a rotary roller bit having an arm-cutter assembly that discharges air into the arm-cutter gap through an annular air chamber. The air flows from the gap and into the borehole to reduce the amount of debris that contacts a seal ring. However, the last machined surface, the backface, or both may wear during operation of the rotary bit. This wearing may cause the gap to widen, increasing the cross-sectional area through which the air flows and reducing the blowing force of the air flow. Such a force reduction often decreases the effectiveness of the air flow in reducing the amount of debris that enters the gap and contacts the seal ring.

U.K. Patent No. 2,019,921, issued to Schumacher and entitled *Drill Bit Air Clearing System,* discloses an earth boring drill having an arm-cutter assembly that discharges air directly into a lone seal gland such that the air flows through the gap and into the borehole. However, the air flow undergoes an abrupt 90 degree shift in direction because the discharge passage is substantially perpendicular to the gap.

This shift causes turbulence that may reduce the effectiveness of the air flow in reducing the amount of debris entering the seal gland. Moreover, the passage discharges the air toward the gap side of the seal, such that debris entering the seal gland may be forced against the seal. As discussed above, this debris may wear the seal, enter the bearing-surface regions, and reduce the useful life of the drill bit.

A variation of the arm-cutter assembly of U.K. Patent No. 2,019,921 has a discharge passage that directs air perpendicularly into the gap instead of the seal gland. An annular, metal seal forms a debris barrier between the gap and the seal gland. As discussed above, air flow turbulence caused by the 90 degree direction shift may reduce the effectiveness of the air flow in reducing the amount of debris that enters the seal gland through the gap and may force debris against the metal seal. This debris may wear or otherwise circumvent the metal seal, enter the seal gland, wear the inner seal, and enter the bearing-surface regions.

U.S. Pat. No. 4,981,182, issued to Dysart and entitled *Sealed Rotary Blast Hole Drill Bit Utilizing Air Pressure For Seal Protection,* discloses an inner seal in an inner seal gland, an outer seal that divides an outer seal gland into two regions, and a porous gas restrictor between the outer seal gland and the gap.

SUMMARY OF THE INVENTION

A need has arisen for a rotary cone drill bit having a support arm-cutter assembly that provides a more effective and longer lifetime protection against borehole debris.

In accordance with the present invention, a rotary cone drill bit having an improved support arm-cutter assembly is provided that substantially eliminates or reduces disadvantages and problems associated with prior rotary cone rock bits.

According to one embodiment of the present invention, a support arm-cutter assembly of a rotary cone drill bit for forming a borehole is provided. A support arm is integrally formed with the drill bit's body. A spindle is formed integral to the arm. The assembly also includes a cutter that has a cavity for receiving the spindle. An inner seal gland is formed between the spindle and a wall of the cavity. An elastomeric seal is disposed in the inner seal gland and forms a first fluid barrier between the borehole and a lower portion of the cavity. An outer seal gland is formed between the spindle and the cavity wall and between the inner seal gland and the borehole. A ring is disposed in the outer seal gland so as to rotate with the cutter. The ring has a peripheral hole therethrough. A gas conduit is disposed within the support arm for directing a flow of a gas, such as air, into the outer seal gland. From the outer seal gland, the gas is directed through the hole in the ring and exits into the borehole to form high velocity jets of air to clean a mating surface between the arm and the cutter outside the outer seal gland, preventing borehole debris from entering the inner seal gland.

According to another embodiment of the present invention, the ring comprises a flat seal having a plurality of holes therethrough.. The flat seal is compressed within the outer seal gland to form a second fluid barrier between the borehole and the spindle. The flat seal may rotate with the cutter or may remain stationary with respect to the spindle. In a similar embodiment of the present invention, the flat seal may comprise a Belleville spring coated with an elastomeric material such as rubber.

In a further embodiment of the present invention, the support arm comprises a reservoir for storing a lubricant, such as grease. A lubricant conduit extends from the reservoir to a bearing-surface region between the spindle and the cavity wall. A pressure-equalization conduit extends between the reservoir and the borehole. Thus, the pressure within the reservoir remains in a desired range to maintain a portion of the lubricant in the bearing-surface region. In a similar embodiment of the present invention, the pressure-equalization conduit extends between the reservoir and the gas conduit to provide a similar result.

A technical advantage provided by the present invention is the formation of high velocity jets of air that clean the gap between the arm and the cone outside the outer seal gland. These high velocity jets of air are considerably more effective than gas flows of conventional arm-cutter assemblies in reducing the amount of borehole debris entering the inner seal gland through the arm-cutter gap.

Another technical advantage provided by the present invention is a gas flow that is independent of the arm-cutter gap width. A further technical advantage provided by the present invention is a gas flow having reduced turbulence.

DETAILED DESCRIPTION OF THE INVENTION

The preferred embodiments of the present invention and its advantages are best understood by referring to FIGS. 1–4 of the drawings, like numerals being used for like and corresponding parts of the various drawings.

Figure 1:
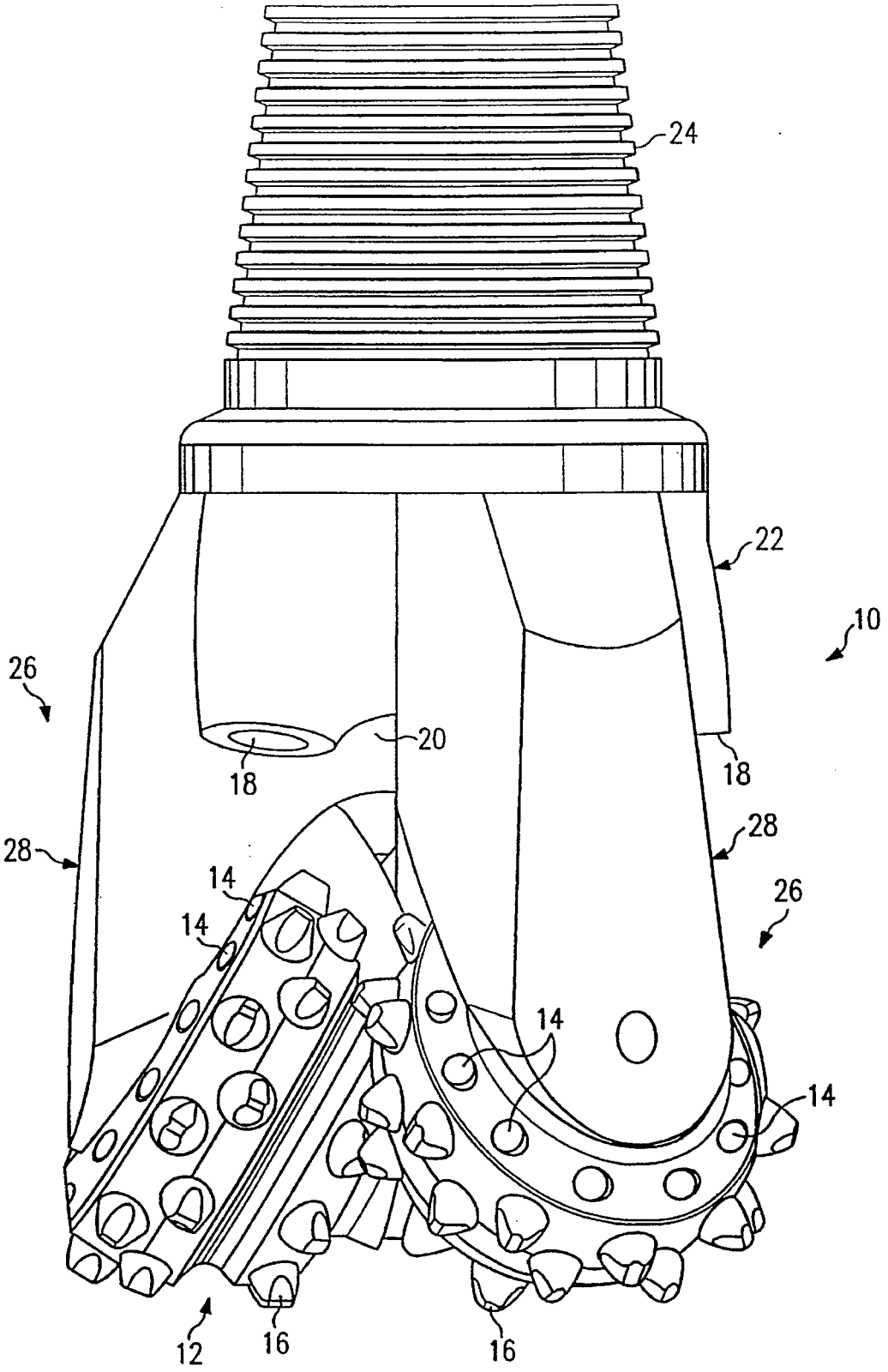
FIG. 1 illustrates an isometric view of a rotary cone drill bit constructed according to the teachings of the present invention.

FIG. 1 illustrates a rotary cone drill bit 10 of the type used in drilling a borehole in the earth. Drill bit 10 may also be referred to as a "roller cone rock bit" or "rotary rock bit." With rotary cone drill bit 10, cutting action occurs as cone-shaped cutters 12 are rolled around the bottom of the borehole (not shown) by the rotation of a drill string (not shown) attached to bit 10. Cutters 12 may also be referred to as "rotary cone cutters" or "roller cone cutters." In one aspect of the invention, rotary cone drill bit 10 is used in an air environment for drilling boreholes in rock formations. Such boreholes may be used in oil field applications and for the placement of explosives.

Rotary cone drill bit 10 comprises an enlarged body 22 having a tapered, externally threaded upper section 24 that is adapted to be secured to the lower end of the drill string. Depending from body 22 are three support arm-cutter assemblies 26 (two visible in FIG. 1). Each support arm-cutter assembly 26 comprises a support arm 28 and a cutter 12. Each support arm 28 includes a spindle 30 formed integral to the arm (shown in FIG. 2). Spindles 30 are preferably angled downwardly and inwardly with respect to bit body 22 so that as bit 10 is rotated, the exteriors of cutters 12 engage the bottom of the borehole. For some applications, spindles 30 may also be tilted at an angle of zero to three or four degrees in the direction of rotation of drill bit 10.

Cutters 12 each include pressed inserts 14 on the gage surface and protruding inserts 16, both of which scrape and gouge against the sides and bottom of the borehole under the down-hole force applied through the drill string. The formation of borehole debris thus created is carried away from the bottom of the borehole by a drilling fluid ejected from nozzles 18 on underside 20 of bit 10. The debris-carrying drilling fluid generally flows radially outward between the underside or the exterior of bit 10 and the borehole bottom. The drilling fluid then flows upwardly towards the surface through an annulus defined between bit 10 and the side wall of the borehole. In air-drilling applications, the drilling fluid is a gas, such as air.

Each of the three cutters 12 generally is constructed and mounted on its associated spindle 30 in a substantially identical manner. Accordingly, only one support arm-cutter assembly 26 is described in detail. It should be understood that such description also applies to the other support arm-cutter assemblies 26.

Figures 2, 3:
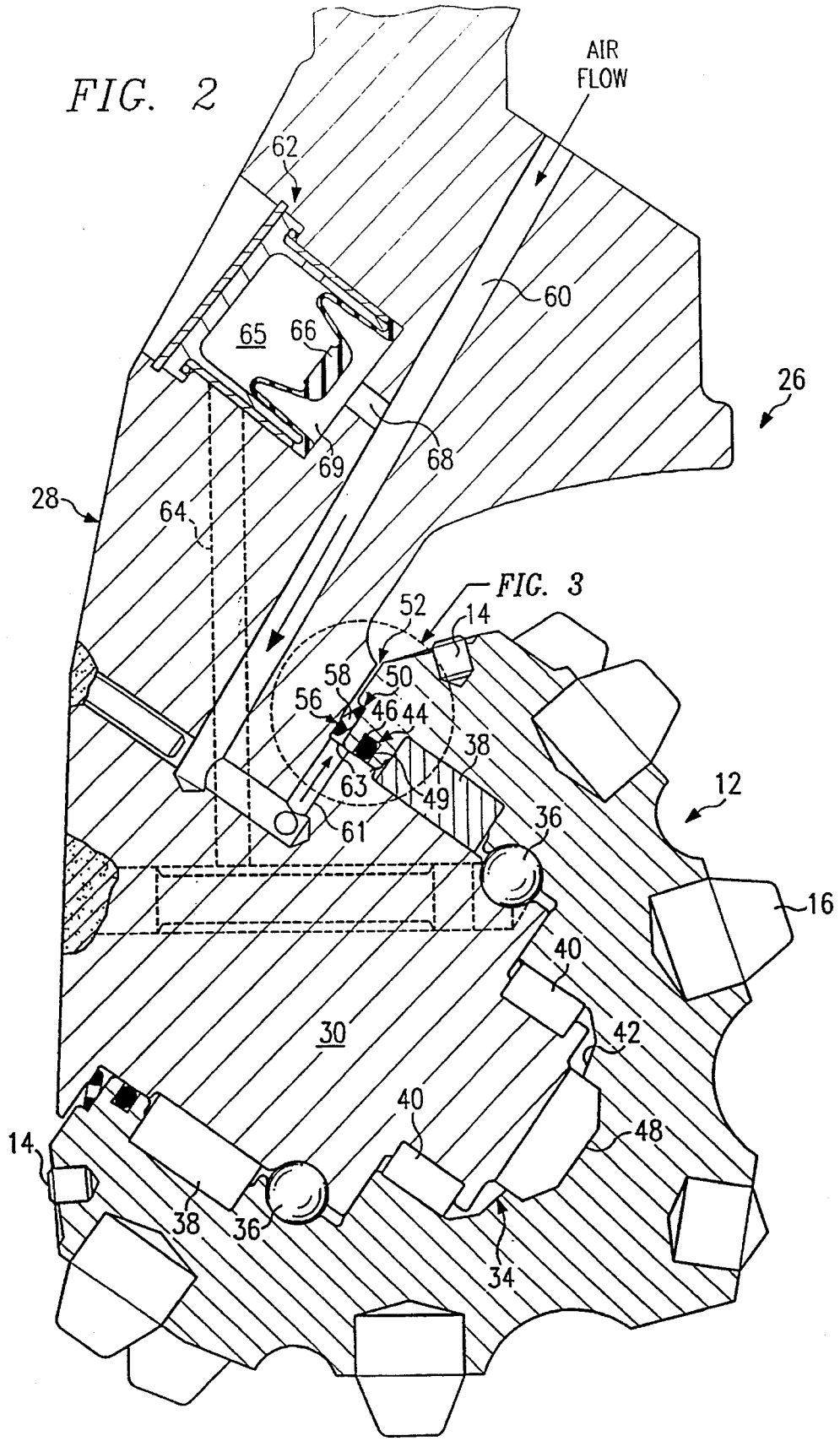
FIG. 2 illustrates a drawing in section with portions broken away of a support arm-cutter assembly of the drill bit of FIG. 1.
FIG. 3 illustrates a drawing in section with portions broken away of the inner and outer seal glands of the support arm-cutter assembly of FIG. 2.
Figure 3:
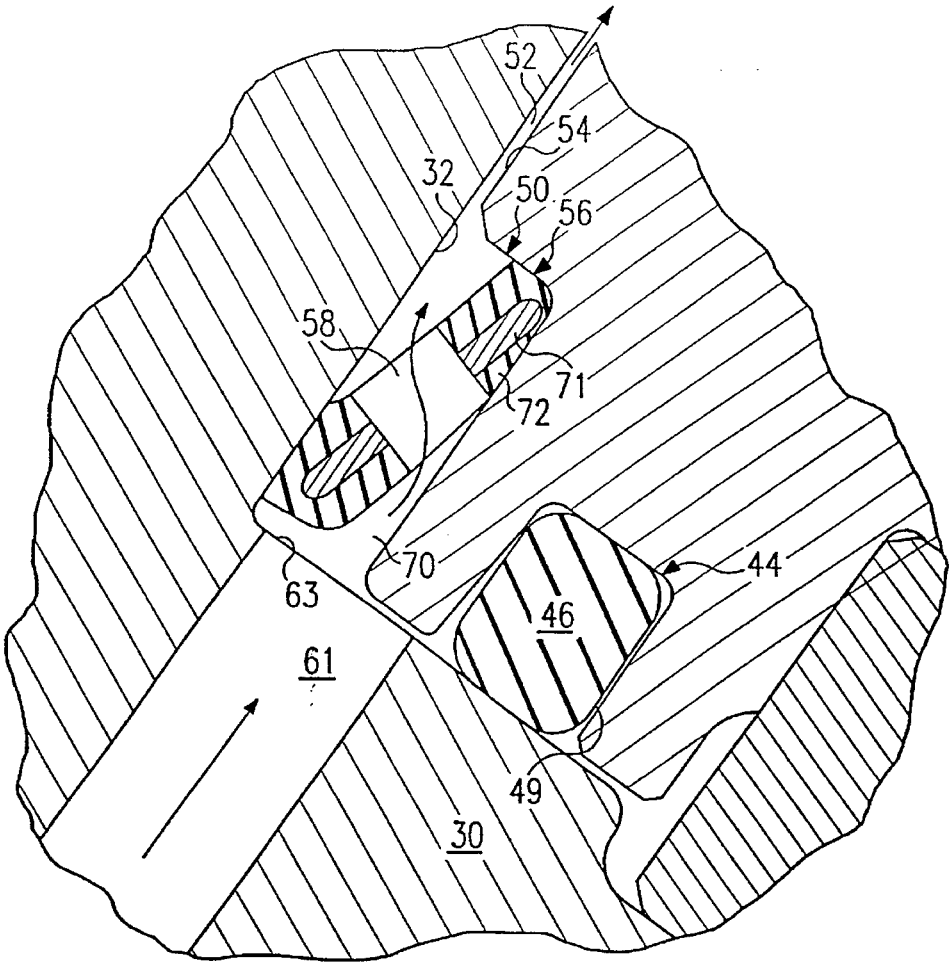

FIG. 2 illustrates a cutaway side view of a support arm-cutter assembly 26 of FIG. 1. As discussed above, support arm-cutter assembly 26 includes a support arm 28 and a cutter 12. Cutter 12 has a generally cylindrical cavity 34 for receiving spindle 30 and is coupled to spindle 30 by a conventional ball retaining system 36. Roller bearings 38 and 40 are disposed between spindle 30 and a cavity wall 42 of cavity 34 as shown. In other embodiments of the present invention, the bearing system may include other types of bearing surfaces.

Cavity wall 42 and spindle 30 form an annular inner seal gland 44 housing an elastomeric seal 46. Seal 46 forms a fluid barrier between the borehole and the lower portion of cavity 34. Cavity 34 extends from a tip 48 of cavity 34 to an adjacent edge 49 of seal gland 44. The fluid barrier formed by seal 46 prevents axially directed fluid flow in a direction substantially parallel to spindle 30 through seal gland 44.

Cavity wall 42 and spindle 30 also form an annular outer seal gland 50 located between inner seal gland 44 and a gap 52 as shown. Gap 52 is located between cutter 12 and a portion of the machined surface of the arm 32. A ring 56 is disposed within outer seal gland 50. Ring 56 has one or more holes 58 formed through its periphery.

Support arm 28 defines a gas conduit 60 and one or more branches 61 that provide a flow of gas from a gas source (not shown) to one or more ports or openings along inner wall 63 of outer gland 50. As shown by the arrows in FIG. 3, this gas flows into outer gland 50, flows through one or more holes 58 and flows through gap 52 into the borehole. The holes 58 form high velocity jets of air that clean the gap between arm 28 and cutter 12 outside outer seal gland 50.

Holes 58 experience little or no wear, and their diameters remain substantially constant. Thus, a widening of gap 52 has little or no effect on the blowing force of the gas flow exiting holes 58. Additionally, the gas flow is more effective than those of conventional devices in preventing debris from entering inner seal gland 44 because holes 58 impart only a gradual direction shift to the gas flow and the gas flow is directed away from the gap side of ring 56. The structure and operation of the outer seal gland 50 and ring 56 combination are discussed further below in conjunction with FIG. 3.

Support arm 28 defines a reservoir, indicated generally at 62, that contains a lubricant, such as grease, for lubricating bearing surfaces 38 and 40 and other points of contact within the bearing-surface regions between cavity wall 42 and spindle 30. A lubricant conduit 64 couples the lubricant from reservoir 62 to the bearing-surface regions. The lubrication of these bearing-surface regions increases the useful life of arm-cutter assembly 26 and rotary drill bit 10.

Reservoir 62 includes a lubricant chamber 65 and a pressure-compensation chamber 69. Reservoir 62 also includes a diaphragm 66 that flexes or moves in response to borehole pressure and lubricant variations to maintain the pressure inside chamber 65 within a desired range. In one embodiment of the present invention, diaphragm 66 is a membrane formed from a flexible material such as rubber. A pressure-equalization conduit 68 couples gas conduit 60 and pressure-compensation chamber 69. Any pressure variations in the borehole also occur within conduit 60 and chamber 69 because gas conduit 60 communicates with the borehole via holes 58, gap 52, and nozzle 18. These pressure variations vary the position of diaphragm 66. This provides pressure compensation to equalize the pressure on either side of the inner seal to prevent extrusion and compensate for minor lubricant losses. In another embodiment of the present invention, pressure-equalization conduit 68 communicates directly with the borehole instead of gas conduit 60 to provide pressure compensation to reservoir 62 as described above.

In operation, cutters 12 rotate about spindles 30 as the drill string rotates bit 10. Reservoir 62 provides lubricant to the bearing-surface regions between cavity wall 42 and spindle 30. The lubricant facilitates the rotation of cutters 12 about spindles 30 by reducing friction amongst cavity wall 42, spindle 30, bearing surfaces 38 and 40, and ball retaining system 36. A gas, such as air, directed downhole by a compressor (not shown) at the surface typically flows from conduit 60, through branches 61, through the openings in inner wall 63, through the inner portion of outer seal gland 50, through holes 58, through the outer portion of gland 50, through gap 52, and into the borehole. This forms high velocity jets of air to clean the mating surface between arm 28 and cutter 12. This reduces or eliminates the amount of borehole debris that enters inner seal gland 44, increasing the useful life of support arm-cutter assemblies 26 and drill bit 10.

FIG. 3 illustrates a close-up cut-away view of inner seal gland 44, outer seal gland 50, and gap 52 of arm-cutter assembly 26 shown in FIG. 2. In one embodiment aspect of the present invention, ring 56 is a flat seal comprising a Belleville spring 71 having a coating 72 of an elastomeric material. Ring 56 forms a second fluid barrier between gap 52 and spindle 30 except for holes 58 as described above. Ring 56 is discussed in more detail below in conjunction with FIG. 4. Ring 56 prevents fluid from flowing in a radial direction within outer seal gland 50 other than through holes 58.

In one embodiment of the present invention, ring 56 rotates with cutter 12. Ring 56 may be integral with or attached to cutter 12, such as with a weld joint, press fit, or adhesive to facilitate this rotation. In addition, the compression force between ring 56 and cavity wall 42 may be made greater than that between ring 56 and spindle 30 or inner wall 32. This compression-force differential may be generated by making the surface area of ring 56 that abuts cavity wall 42 greater than that abutting spindle 30 or inner surface 32. In this embodiment of the present invention, one hole 58 is sufficient to reduce or eliminate the amount of borehole debris that enters inner seal gland 44 via gap 52 and clean the mating surface between cutter 12 and arm 28 because ring 56 rotates with cutter 12.

In another embodiment of the present invention, ring 56 remains stationary with respect to spindle 30. Ring 56 may be formed integrally with or attached to spindle 30, such as with a weld joint, press fit, or adhesive. Additionally, the compression force between ring 56 and spindle 30 or inner surface 32 may be made greater than that between ring 56 and cavity wall 42. This compression-force differential may be generated by making the surface area of ring 56 that abuts spindle 30 or inner surface 32 greater than that abutting cavity wall 42. In this embodiment of the present invention, ring 56 typically has a plurality of holes 58 to reduce or eliminate the amount of borehole debris that enters inner seal gland 44 via gap 52 because ring 56 remains stationary with respect to spindle 30.

Figure 4:
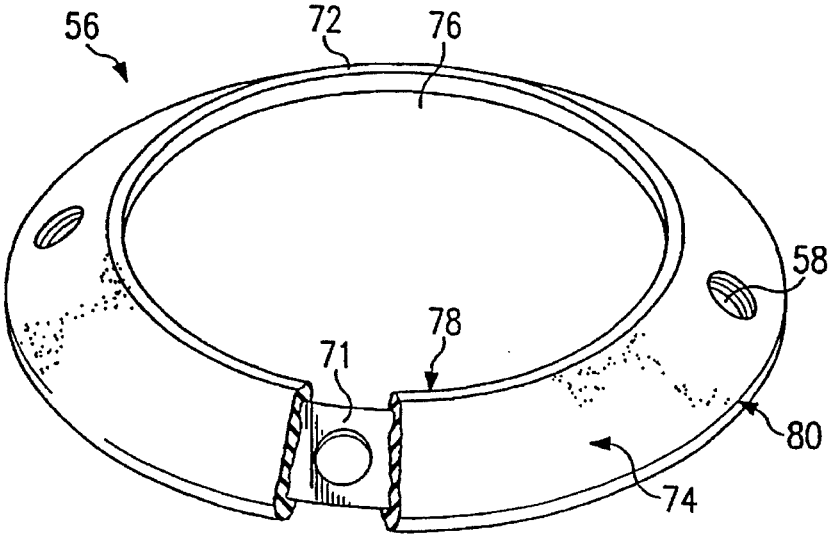
FIG. 4 illustrates an isometric view of one embodiment of a Belleville spring used with the support arm-cutter assembly of FIG. 2 according to the teachings of the present invention.

FIG. 4 illustrates an isometric view of a flat seal used for ring 56 of FIGS. 2 and 3. As shown, a Belleville spring 71 may be coated with an elastomeric material 72, such as rubber, to improve the sealing ability of ring 56 around the edges of periphery 74. As discussed above, periphery 74 of ring 56 has one or more holes 58 formed therethrough. In the illustrated embodiment, holes 58 are shown evenly spaced, equally sized, and centered within periphery 74. The present invention contemplates holes 58 that are unevenly spaced, unequally sized, or offset from each other or the periphery center. Further, the shape of exit holes 58 can comprise any shape and are shown as circular in cross-section for purposes of illustration. The teachings of the present invention are not limited to circular holes.

During assembly of arm-cutter assembly 26 (FIG. 2), center opening 76 of ring 56 is slipped over spindle 30 until bottom edge 78 abuts last machined surface 32 of support arm 28. As cutter 12 is installed onto spindle 30, the inner and side walls of outer seal gland 50 formed by cavity wall 42 compress outer edge 80 of spring 71 toward inner surface 32. This compression forces bottom edge 78 against inside surface 32 and forces outer edge 80 against the inner wall of outer seal gland 50 forming the second fluid barrier (except for one or more holes 58) as described above in conjunction with FIG. 3.

Although discussed for use in air drilling applications, the present invention may be used in other types of drilling applications where a fluid, such as a drilling fluid, flows through conduit 60 into outer seal gland 50 to reduce the amount of borehole debris that enters inner seal gland 44 via gap 52.

Although the present invention and its advantages have been described in detail, it should be understood that various changes, substitutions and alterations can be made therein without departing from the spirit and scope of the invention as defined by the appended claims.

What is claimed is:

1. A support arm-cutter assembly of a rotary cone drill bit for forming a borehole, comprising:

a support arm integrally formed with a body of the rotary cone rock bit and having a last machined surface;

a spindle formed integral to the last machined surface;

a cutter having a cavity for receiving the spindle, the cutter forming an inner seal gland between the spindle and a wall of the cavity and forming an outer seal gland between the spindle and the wall of the cavity outward from the inner seal gland;

an elastomeric seal disposed in the inner seal gland and forming a first fluid barrier between the borehole and a lower portion of the cavity;

a ring disposed in the outer seal gland, the ring having at least one hole therethrough;

the ring coated with an elastomeric material and the at least one hole extending through the elastomeric material; and a gas conduit disposed within the support arm for directing a flow of a gas into the outer seal gland such that the gas is directed through the hole in the ring and exits into the borehole to form high velocity jets of air to clean a mating surface between the arm and the cutter outside the outer seal gland, preventing borehole debris from entering the inner seal gland.

2. The assembly of claim 1, wherein the ring comprises a flat seal compressed within the outer seal gland to form a second fluid barrier between the borehole and the spindle except for the at least one hole.

3. A support arm-cutter assembly of a rotary cone drill bit for forming a borehole, comprising:

a support arm integrally formed with a body of the rotary cone rock bit and having a last machined surface;

a spindle formed integral to the last machined surface;

a cutter having a cavity for receiving the spindle, the cutter forming an inner seal gland between the spindle and a wall of the cavity and forming an outer seal gland between the spindle and the wall of the cavity outward from the inner seal gland;

an elastomeric seal disposed in the inner seal gland and forming a first fluid barrier between the borehole and a lower portion of the cavity;

a ring disposed in the outer seal gland, the ring having at least one hole therethrough;

a gas conduit disposed within the support arm for directing a flow of a gas into the outer seal gland such that the gas is directed through the hole in the ring and exits into the borehole to form high velocity jets of air to clean a mating surface between the arm and the cutter outside the outer seal gland, preventing borehole debris from entering the inner seal gland;

the ring providing a fiat seal compressed within the outer seal gland to form a second fluid barrier between the borehole and the spindle except for the at least one hole; and the ring further comprising a Belleville spring coated with an elastomeric material.

4. The assembly of claim 1, wherein the ring rotates with the cutter.

5. The assembly of claim 4, wherein the ring is attached to the cutter.

6. The assembly of claim 1, wherein the ring remains stationary with respect to the spindle.

7. The assembly of claim 6, wherein the ring is attached to the spindle.

8. The assembly of claim 1, wherein the ring has a plurality of holes therethrough.

9. The assembly of claim 1, wherein support arm further comprises:

a reservoir for storing a lubricant;

a lubricant conduit for allowing the lubricant to travel from the reservoir to a bearing-surface region between the spindle and the cavity;

a pressure-equalization conduit extending between the reservoir and the gas conduit; and wherein the pressure within the reservoir remains in a desired range to maintain a portion of the lubricant in the region.

10. The assembly of claim 1, wherein the gas comprises air.

11. A rotary cone drill bit for forming a borehole, comprising:

a body having an underside and having an upper end portion adapted for connection to a drill string for rotation of the body; and a plurality of angularly spaced support arm-cutter assemblies integrally formed with the body and depending therefrom, each of the assemblies comprising:

a support arm integrally formed with a body of the rotary cone rock bit;

a spindle formed integral with the support arm;

a cutter having a cavity for receiving the spindle, the cutter forming an inner seal gland between the spindle and a wall of the cavity and forming an outer seal gland between the spindle and the wall of the cavity outward from the inner seal gland;

an elastomeric seal disposed in the inner seal gland and forming a first fluid barrier between the borehole and a lower portion of the cavity;

a ring disposed in the outer seal gland, the ting having a plurality of generally circular holes extending through the periphery of the ring; and a gas conduit disposed within the support arm for directing a flow of a gas into the outer seal gland such that the gas is directed through the holes in the ring and exits into the borehole to form high velocity jets of air to clean a mating surface, preventing borehole debris from entering the inner seal gland between the support arm and the cutter outside the outer seal gland.

12. The drill bit of claim 11, comprising three support arm-cutter assemblies.

13. The assembly of claim 1, wherein the ting comprises a fiat seal compressed within the outer seal gland to form a second fluid barrier between the borehole and the spindle except for the holes.

14. The assembly of claim 11, wherein each support arm further comprises:

a reservoir for storing a lubricant;

a lubricant conduit for allowing the lubricant to travel from the reservoir to a bearing-surface region between the spindle and the cavity;

a pressure-equalization conduit extending between the reservoir and the gas conduit; and wherein the pressure within the reservoir remains in a desired range to maintain a portion of the lubricant in the region.

15. The assembly of claim 11, wherein the gas comprises air.

16. A rotary cone drill bit for forming a borehole comprising:

a body having an underside and having an upper end portion adapted for connection to a drill string for rotation of the body; and a plurality of angularly spaced support arm-cutter assemblies integrally formed with the body and depending therefrom, each of the assemblies comprising:

a support arm integrally formed with a body of the rotary cone rock bit;

a spindle formed integral with the support arm;

a cutter having a cavity for receiving the spindle, the cutter forming an inner seal gland between the spindle and a wall of the cavity and forming an outer seal gland between the spindle and the wall of the cavity outward from the inner seal gland;

an elastomeric seal disposed in the inner seal gland and forming a first fluid barrier between the borehole and a lower portion of the cavity:

a ring disposed in the outer seal gland, the ring having at least one hole therethrough;

a gas conduit disposed within the support arm for directing a flow of a gas into the outer seal gland such that the gas is directed through the hole in the ring and exits into the borehole to form high velocity jets of air to clean a mating surface, preventing borehole debris from entering the inner seal gland between the support arm and the cutter outside the outer seal gland;

three support arm-cutter assemblies; and a flat seal compressed within the outer seal gland forming a second fluid barrier between the borehole and the spindle except for the at least one hole and comprising a Belleville spring coated with an elastomeric material.

17. A method for preventing borehole debris from entering an inner seal gland formed between a spindle of a support arm and a cavity wall of a rotary cone cutter, comprising the steps of:

forming a conduit within the support arm such that the conduit is in fluid communication with an outer seal gland formed between the spindle and the cavity wall and positioned between the inner seal gland and a borehole;

forming a ring with a plurality of holes in the periphery of the ring;

placing the ring in the outer seal gland to form a fluid barrier between borehole and the spindle except for the holes in the periphery of the ring; and directing a flow of gas through the conduit into the outer seal gland, through the holes, and exiting into the borehole to form a high velocity jet of air.

18. The method of claim 17, wherein the gas comprises air.

19. A method for preventing borehole debris from entering an inner seal gland formed between a spindle of a support arm and a cavity wall of a rotary cone cutter, comprising the steps of:

forming a conduit within the support arm such that the conduit is in fluid communication with an outer seal gland formed between the spindle and the cavity wall and positioned between the inner seal gland and borehole;

forming a ring with at least one hole extending through the periphery of the ring;

placing the ring in the outer seal gland such that a flow of gas directed through the conduit flows into the outer seal gland, through the at least one hole, and exits into the borehole to form a high velocity let of air; and forming the ring from a Belleville spring coated with an elastomeric material and compressing the Belleville spring within the outer seal gland to form a fluid barrier between the borehole and the spindle except for at least one hole.

20. A method for forming a support arm-cutter assembly of a rotary cone drill bit for forming a borehole, comprising the steps of:

forming a support and integrally with a body of the rotary cone drill bit, the support arm having a spindle formed integral to last machined surface;

attaching a cutter having a cavity to the spindle to form an inner and an outer seal gland between the spindle and a wall of the cavity, the outer seal gland located between the inner seal gland and the borehole;

placing an elastomeric seal in the inner seal gland to form a first fluid barrier between the borehole and a lower portion of the cavity;

forming a ring with at least one hole extending through the periphery of the ring;

placing the ring in the outer seal gland;

forming a gas conduit within the support arm for directing a flow of a gas into the outer seal gland such that the gas conduit directs the gas through the at least one hole and into the borehole to form a high velocity jet of air to clean a mating surface between the support arm and the cutter outside the outer seal gland, preventing borehole debris from entering the inner seal gland during operation of the drill bit; and compressing the ring in the outer seal gland to form a flat seal providing a second fluid barrier between the borehole and the spindle except for the at least one hole extending through the ring.

21. The method of claim 20, further comprising the step of compressing the flat seal so that the flat seal rotates with the cutter.

22. The method of claim 20, further comprising the step of attaching the flat seal to the cutter.

23. The method of claim 20, further comprising the step of compressing the flat seal so that the flat seal remains stationary with respect to the spindle.

24. The method of claim 20, further comprising the step of attaching the flat seal to the spindle.

25. The method of claim 20, further comprising:

forming a reservoir in the support arm for storing a lubricant;

forming a lubricant conduit in the support arm for allowing the lubricant to travel from the reservoir to a bearing-surface region between the spindle and the cavity;

forming in the support arm a pressure-equalization conduit that extends from the reservoir to the gas conduit such that the pressure within the reservoir remains in a desired range to maintain a portion of the lubricant in the region.

26. A method for forming a support arm-cutter assembly of a rotary cone drill bit for forming a borehole, comprising the steps of:

forming a support arm integrally with a body of the rotary cone drill bit, the support arm having a spindle formed integral to last machined surface;

attaching a cutter having a cavity to the spindle to form an inner and an outer seal gland between the spindle and a wall of the cavity, the outer seal gland located between the inner seal gland and the borehole;

placing an elastomeric seal in the inner seal gland to form a first fluid barrier between the borehole and a lower portion of the cavity;

forming a ring having a plurality of generally circular holes extending through the periphery of the ring;

placing the ring in the outer seal gland;

forming a gas conduit within the support arm for directing a flow of a gas into the outer seal gland such that the gas conduit directs the through the hole and into the borehole to form a high velocity jet of air to clean a mating surface between the support arm and the cutter outside the outer seal gland, preventing borehole debris from entering the inner seal island during operation of the drill bit;

forming a second fluid barrier between the borehole and the spindle by compressing the ring to provide a fiat seal; and the step of placing the ring comprises placing a fiat seal comprising a Belleville spring coated with an elastomeric material and compressing the spring within the outer seal gland to form the second fluid barrier.

* * * * *